US007179154B1

(12) United States Patent
Boyd et al.

(10) Patent No.: US 7,179,154 B1
(45) Date of Patent: Feb. 20, 2007

(54) METHOD AND APPARATUS FOR CLEANING A WAFER BEVEL EDGE AND NOTCH USING A PIN AND AN ABRASIVE FILM CASSETTE

(75) Inventors: John M. Boyd, Hillsboro, OR (US); Fritz Redeker, Fremont, CA (US); Jason Ryder, Oakland, CA (US); Aleksander Owczarz, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 11/242,705

(22) Filed: Oct. 3, 2005

Related U.S. Application Data

(63) Continuation-in-part of application No. 11/172,270, filed on Jun. 29, 2005, now Pat. No. 7,115,023.

(51) Int. Cl.
*B24B 1/00* (2006.01)
*B24B 7/00* (2006.01)

(52) U.S. Cl. ..... 451/44; 451/43; 451/59; 451/303; 451/307

(58) Field of Classification Search ..... 451/43, 451/44, 59, 303, 307
See application file for complete search history.

(56) References Cited

U.S. PATENT DOCUMENTS

| | | | | |
|---|---|---|---|---|
| 5,727,990 | A * | 3/1998 | Hasegawa et al. | 451/44 |
| 6,227,947 | B1 * | 5/2001 | Hu et al. | 451/56 |
| 6,558,239 | B2 * | 5/2003 | Kunisawa et al. | 451/303 |
| 6,739,954 | B2 * | 5/2004 | Stocker | 451/57 |
| 2003/0003853 | A1 * | 1/2003 | Stocker | 451/57 |
| 2004/0185751 | A1 * | 9/2004 | Nakanishi et al. | 451/5 |
| 2005/0245174 | A1 * | 11/2005 | Toyota et al. | 451/41 |

* cited by examiner

*Primary Examiner*—Joseph J. Hail, III
*Assistant Examiner*—Robert Scruggs
(74) *Attorney, Agent, or Firm*—Martine Penilla & Gencarella, LLP

(57) ABSTRACT

An apparatus for cleaning a semiconductor wafer edge is provided. The apparatus includes a film with an abrasive layer configured to contact the edge surface of a semiconductor substrate coated with a contaminant residue layer. A first reel having the film wound thereon and a second reel for receiving the film fed from the first reel are included. In one embodiment, a third reel configured to force the abrasive layer of the film against the edge surface of the semiconductor substrate so as to create an area of contact between the abrasive layer and the edge surface of the semiconductor substrate; and a pin that protrudes from to the top surface of the third reel. A system and method for cleaning a semiconductor wafer edge are also provided.

19 Claims, 12 Drawing Sheets

METHOD AND APPARATUS FOR CLEANING A WAFER BEVEL EDGE AND NOTCH USING A PIN AND AN ABRASIVE FILM CASSETTE

CROSS REFERENCE TO RELATED APPLICATIONS

This application is a continuation-in-part and claims priority from U.S. patent application Ser. No. 11/172,270 filed on Jun. 29, 2005 now U.S. Pat. No. 7,115,023 and entitled "Process Tape for Cleaning or Processing the Edge of a Semiconductor Wafer," which is incorporated herein by reference in its entirety for all purposes.

BACKGROUND

Semiconductor chip fabrication is a complicated process that involves a coordinated series of precise operations. These operations can be broadly characterized to include such steps as layering, patterning, etching, doping, chemical mechanical polishing (CMP), etc. It is well known that during the various steps in these operations, the surfaces, edges, bevels and notches of the semiconductor wafers become contaminated with a layer of residue comprised of particulates, organic materials, metallic impurities, and native oxides. The removal of these contaminants is a priority to semiconductor chip fabricators because the level of contamination on the wafer inversely correlates to the integrated circuit (IC) chip yield for each wafer and the overall reliability of those IC chips.

Some examples of operations that may result in unwanted wafer contamination include plasma etching (e.g., electron cyclotron resonance (ECR)) and CMP. During plasma etching, the wafer is placed in a reaction chamber and exposed to charged plasma which physically or chemically removes layers of material off the wafer surface. After the etching process is complete, a post-etch cleaning step follows whereby contaminant residue deposited on the wafer during the etching process is removed. Typically, this involves the application of chemistry to the front and back surfaces of the wafer followed by rinsing and drying. When using the optimal chemistry and tool settings, this post-etch cleaning step significantly removes or reduces the amount of post-etch contaminant residue on the wafer.

However, one type of post-etch residue that does not readily lend itself to removal by conventional post-etch chemical-based cleaning methods is organic polymer residue found on the wafer bevel edge, notch, and the portion of the backside of the wafer that overhangs the electrostatic chuck of the etch reactor system. This polymer residue is relatively inert and is not soluble in most known wafer-compatible chemicals. As semiconductor fabricators look towards shrinking the edge exclusion zone of the semiconductor wafer to increase the wafer's IC chip yield, it is becoming increasingly important to remove this type of residue.

Today, mechanical cleaning tools such as brush scrubbers and bevel edge cleaning wheels are used to remove polymer residue from the wafer. One system configuration may include the use of a plurality of rollers to hold and rotate the wafer, a double-sided scrubber that simultaneously scrubs the front and back surfaces of the wafer, and a bevel edge cleaning wheel that cleans the bevel edge of the wafer. Brush scrubbers are mechanically rotating brushes that scrub the top and back surfaces of the wafer to remove the polymer residue. Brush scrubbing is effective at removing the contaminants and certain types of residue on the front and back side of the wafer but is not effective at removing the polymer residue attached to the wafer bevel edge and notch.

A bevel edge cleaning wheel cleans the bevel edge of the wafer by using an abrasive wheel that rotates at a different tangential velocity than the wafer to mechanically sheer off the contaminant residue at the point of contact between the wafer bevel edge and the wheel. The difficulty with using a bevel edge cleaning wheel is that it requires an abrasive incorporated into the wheel material, which becomes worn with repeated use and therefore requires frequent replacement. Additionally, contaminant particles that are loaded onto the abrasive wheel during cleaning can become dislodged and end up as defects on the wafer. Likewise, all of the above methods and tools fail to clean the wafer notch. These shortcomings with the current methods and tools may cause greater process downtime for equipment maintenance, reduced fabrication process throughput, and decreased IC chip yield for each wafer.

In view of the forgoing, there is a need for a cleaning apparatus that avoids the problems of the prior art by allowing for the cleaning of both the bevel edge and notch of the semiconductor wafer. Further, there is a need for a bevel edge cleaning device that will not require frequent replacement and will not result in residue particles being dislodged onto the wafer during cleaning.

SUMMARY

Broadly speaking, the present invention fills these needs by providing an improved apparatus for cleaning the bevel edge and notch of the semiconductor wafer. It should be appreciated that the present invention can be implemented in numerous ways, including as a system, an apparatus and a method. Several inventive embodiments of the present invention are described below.

In one embodiment, an apparatus for cleaning a semiconductor wafer bevel edge and notch is disclosed. The apparatus includes a film with an abrasive layer configured to contact the edge surface of a semiconductor substrate coated with a contaminant residue layer. A first reel having the film wound thereon and a second reel for receiving the film fed from the first reel are included. In one embodiment, a third reel configured to force the abrasive layer of the film against the edge surface of the semiconductor substrate so as to create an area of contact between the abrasive layer and the edge surface of the semiconductor substrate; and a pin that protrudes from to the top surface of the third reel.

In another embodiment, a system for cleaning the bevel edge and notch of a semiconductor substrate is disclosed. The system includes a cassette with a plurality of reels that hold an abrasive film. The cassette is configured to allow the reels to orient and force the abrasive film to contact the bevel edge surface of a semiconductor substrate. The system also has at least one nozzle that applies a solution stored in a reservoir to the substrate during cleaning. The system additionally has a plurality of rollers that are configured to position and impart rotational motion to the substrate.

In yet another embodiment, a method is disclosed for cleaning the bevel edge surface and notch of a semiconductor substrate. The semiconductor substrate is rotated and an abrasive film is then forced against the bevel edge surface of the semiconductor substrate. Contemporaneously, a nozzle applies a solution to the interface of the abrasive film and semiconductor substrate to facilitate the removal of contaminant residue from the semiconductor substrate. In one embodiment, the abrasive film is lowered below the substrate to allow a pin to be forced against the substrate edge.

BRIEF DESCRIPTION OF THE DRAWINGS

The present invention will be readily understood by the following detailed description in conjunction with the accompanying drawings, and like reference numerals designate like structural elements.

DETAILED DESCRIPTION

An invention is described for apparatuses, systems, and methods for cleaning a semiconductor substrate. It will be obvious, however, to one skilled in the art, that the present invention may be practiced without some or all of these specific details. In other instances, well known process operations have not been described in detail in order not to unnecessarily obscure the present invention.

The embodiments described herein provide apparatuses, systems and methods for cleaning a semiconductor substrate. A semiconductor substrate can be made of any silicon-based material. In one exemplary embodiment, the substrate is a semiconductor wafer, which is a thin slice of semiconductor material, such as a silicon crystal, upon which microcircuits are constructed by diffusion and deposition of various materials. What is disclosed by the embodiments is essentially a semiconductor substrate cleaning system that utilizes shape conforming abrasive film and an abrasive pin to clean contaminant residue off the bevel edge surface and notch of a semiconductor wafer. The terms substrate and wafer are interchangeable as used herein.

Figure 1:
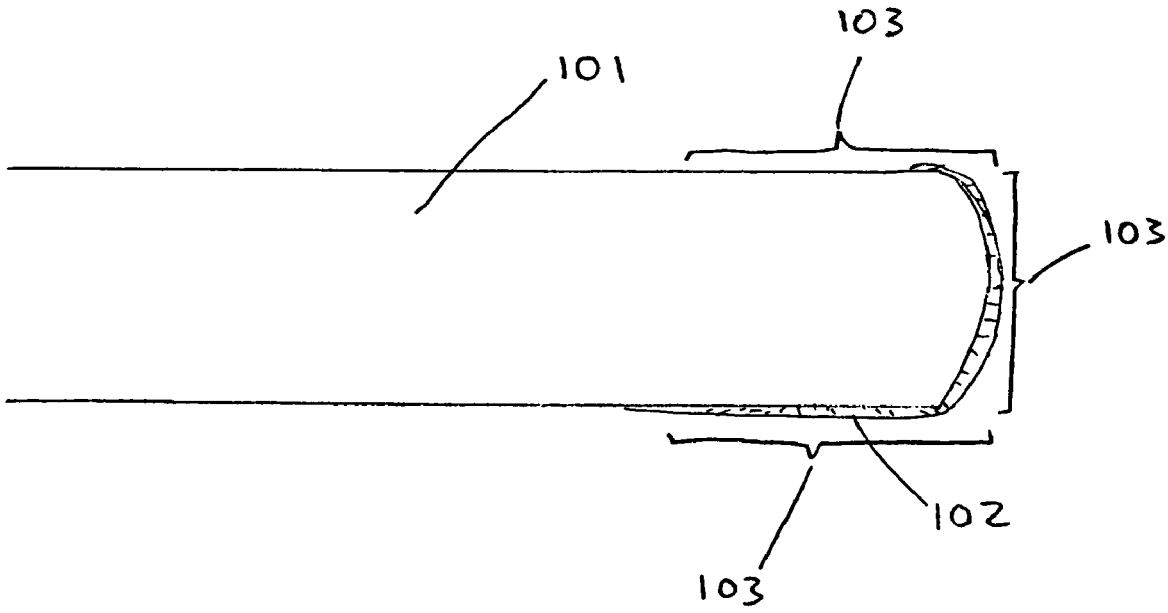
FIG. 1 shows a cross-section view of a semiconductor wafer that has a layer of contaminant residue deposited on its bevel edge surface.

FIG. 1 shows a cross section view of a semiconductor wafer 101 that has a layer of contaminant residue 102 deposited on its bevel edge surface 103. The residue 102 is typically comprised of particulates, organic materials, metallic impurities, and/or native oxides that are generated and deposited after various operations in the wafer fabrication process.

Figure 2A:
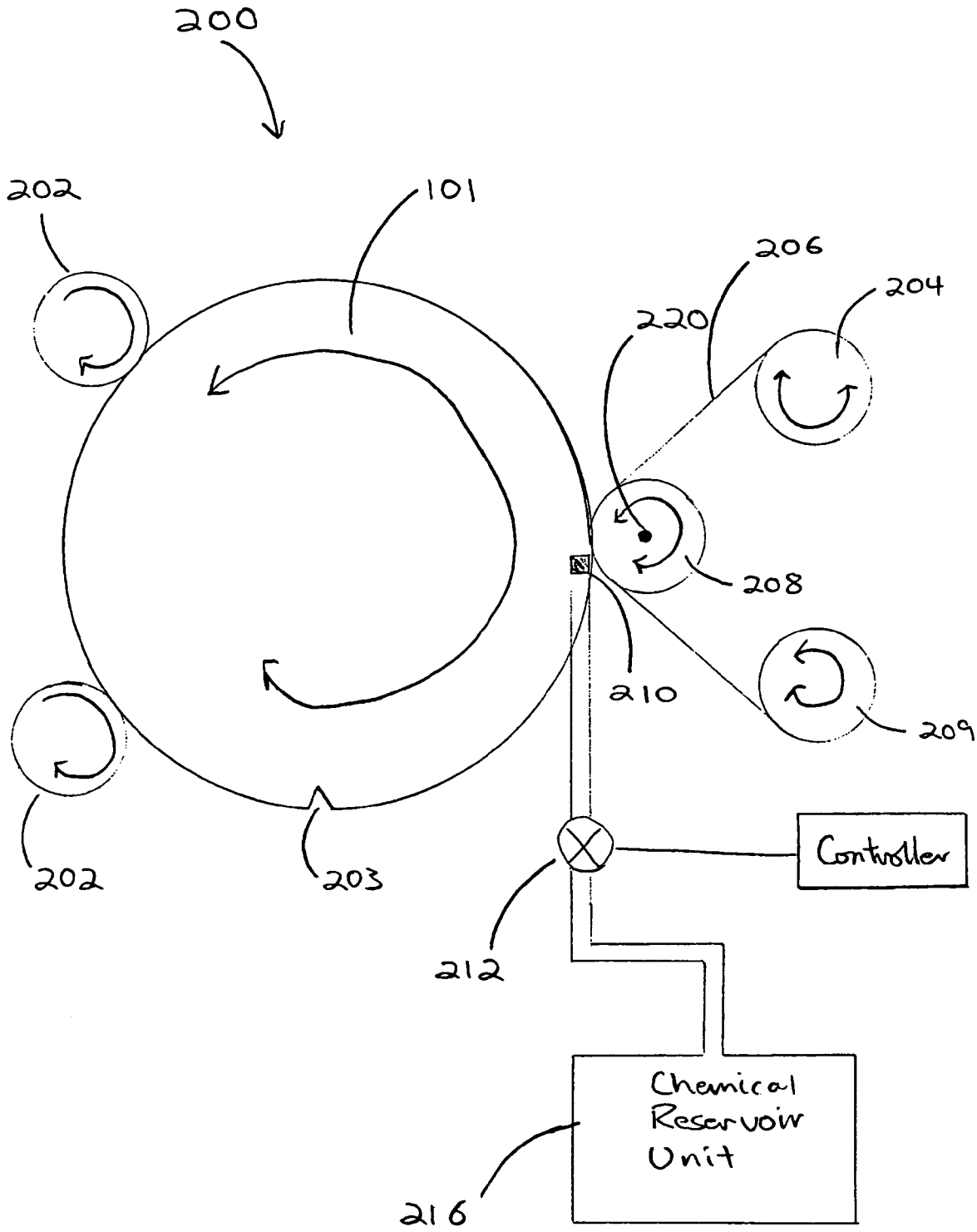
FIG. 2A depicts a high level schematic diagram of a wafer cleaning system, in accordance with one embodiment of the present invention.

FIG. 2A depicts a high level schematic diagram of a wafer cleaning system, in accordance with one embodiment of the present invention. In this particular embodiment, the wafer cleaning system 200 has a set of rollers 202 that are configured to support the wafer 101 and impart rotational velocity to the wafer 101. In one embodiment, the rollers 202 are cylindrical drive wheels, which have longitudinal surfaces that are optimally shaped or compliant to hold the wafer 101. Of course, a rotating chuck may also be used to rotate the wafer 101 eliminating the need for the rollers 202 altogether. It should be appreciated that the wafer 101 may be rotated in the same direction as the reels (204, 208, and 209) or in opposite directions depending on the cleaning requirements of the user. The abrasive film 206 is configured to be wound onto a supply reel 209, buttressed against one side of a stator reel 208, and attached to a rewind reel 204. For this embodiment, the rewind reel 204 is powered by a drive unit that controls the feed rate of the abrasive film 206 at an optimal level for removing the residue off the bevel edge 103. The stator reel 208 is configured to force the abrasive film 206 against the bevel edge of the wafer 101. It should be appreciated that when the stator reel 208 applies force to the point of contact between the bevel edge and the abrasive film 206, enough force is applied to cause the abrasive film to rub the residue off from the bevel edge of the wafer 101 and the nearby edge exclusion zone of the wafer. In one embodiment, the stator reel 208, supply reel 209 and rewind reel 204 are held in a cassette housing that can be easily replaced during maintenance performed on the wafer cleaning system 200. Protruding from the center of the top surface of the stator reel 208 is a pin 220 that has a surface coating of abrasive material. It should be appreciated that the abrasive material has a hardness factor that is less than the hardness of the wafer 101 but greater than the hardness of the contaminant residue.

Still referring to FIG. 2A, the cassette housing holding the stator reel 208, supply reel 209 and rewind reel 204 is configured so that it can be lowered to a position that will allow the pin 220 to contact the wafer notch 203 when necessary. The notch 203 is an area on the bevel edge surface that has been removed for wafer 101 identification purposes. Positioned proximate to the interface between the bevel edge and the abrasive film 206 is a nozzle 210 that delivers chemical solution to the interface to facilitate the removal of contaminant residue from the wafer 101. One skilled in the art will appreciate that while the delivery of the chemical solution is depicted through nozzle 210, this is but one exemplary embodiment. That is, nozzle 210 may simply be a drip tube or any other suitable delivery mechanism commercially available. A number of different chemical solutions can be used for this purpose including: $NH_4OH$ (Ammonium Hydroxide), $H_2O_2$ (Hydrogen Peroxide), TMAH (tetramethylammonium hydroxide), HF (hydrogen fluoride), and amine-based solvents or semiaqueous solvents (such as ST250 or ST255 supplied by ATMI). One skilled in the art will appreciate that the range of chemical solutions/reagents available for this application is vast and that the actual chemical solution utilized will depend largely on the particular application and the type of residue being removed.

A pump 212 delivers the chemical solution that is stored in the chemical reservoir 216 to the nozzle 210 at a flow rate suitable for the application. It should be appreciated that many different commercially available types of pumps can be utilized to deliver the chemical solution including a peristaltic pump, gear pump, impeller pump, air pump, etc. Of course, air pressure may be used where the reservoir 216 is sealed to eliminate the need for a pump.

Figure 2B:
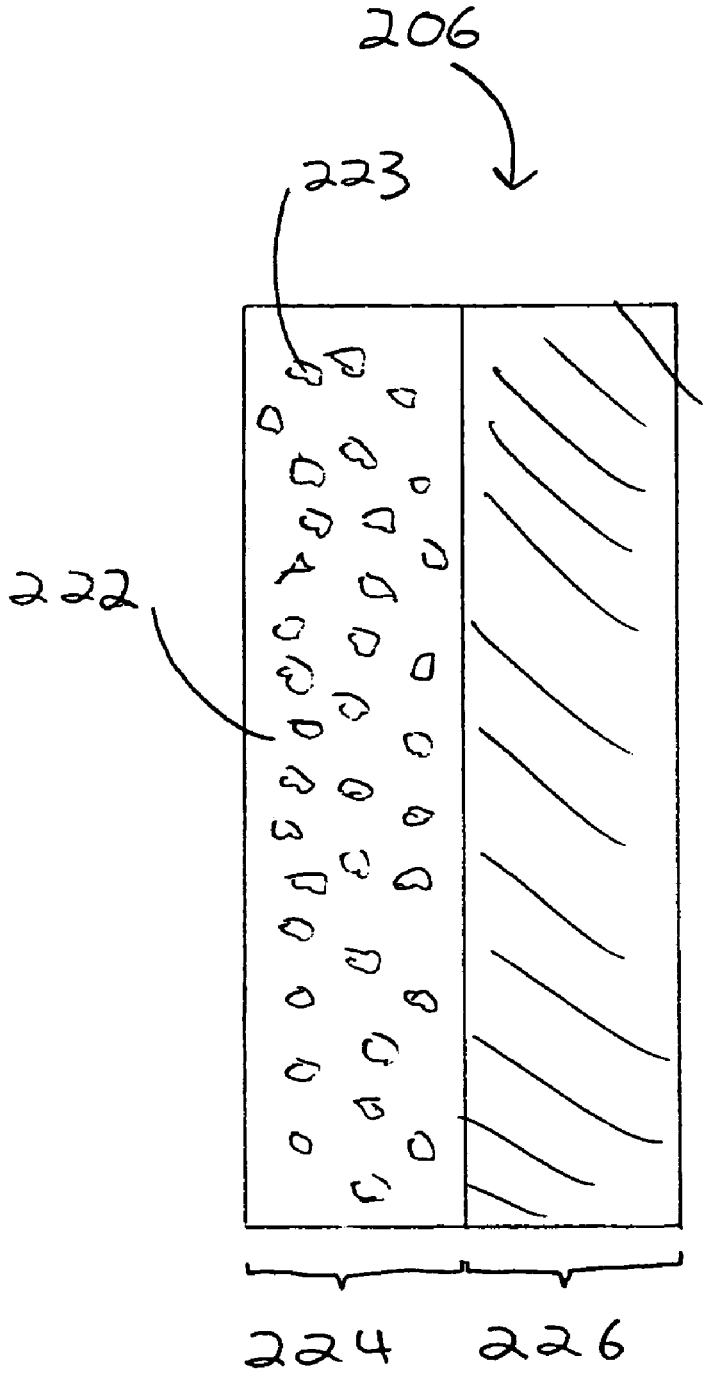
FIG. 2B illustrates a cross sectional view of the abrasive film, in accordance with one embodiment of the present invention.

FIG. 2B illustrates a cross sectional view of the abrasive film, in accordance with one embodiment of the present invention. In this particular embodiment, the abrasive film 206 is made up of two layers, an abrasive layer 224 and a film backing layer 226. One skilled in the art will appreciate that while this depiction shows, a abrasive film 206 with two layers, this is but one exemplary embodiment. The abrasive film 206 can be comprised of a single layer, two or more layers, or any other suitable number of layers depending on the requirements of the user and what is commercially available. Where multiple layers are involved, it will be apparent to one skilled in the art that an adhesive may be used in between the multiple layers.

Still referring to FIG. 2B, in this exemplary embodiment, the abrasive layer 224 is made up of a binder material 222 that is embedded with abradants 223. During a cleaning operation, the stator reel forces the abrasive film 206 and the embedded abradants 223 against the semiconductor wafer. As the wafer is rotated against the abrasive film 206, the abradants 223 dislodge the contaminant residue from the wafer. A number of different types of abradants can be used for this purpose including: alumina ($Al_2O_3$), silica ($SiO_2$), silicon (Si), titania ($TiO_2$), ceria ($CeO_2$), silicon nitride ($Si_3N_4$), etc. However, one skilled in the art will recognize that the abradants can be any suitable material so as long as the material has a hardness factor that is less than the hardness factor of the wafer but greater than the hardness factor of the contaminant residue. One measure of abradant hardness is the Mohs hardness scale, a comparative index of hardness where talc is defined as 1 (least hard) and diamond is defined as 10 (hardest). Using the Mohs scale, the hardness range of the abradant lies between about 3 (the approximate hardness of the contaminant residue layer) and about 7 (the wafer substrate Si, $SiO_2$, $Si_3N_4$, etc.). Example abradant hardness values include titanium oxide (5.5–6.5), cerium oxide (6.5), amorphous silicon oxide (6.5–7), and silicon (7).

Furthermore, one skilled in the art will appreciate that while the abrasive layer 224 is shown with abradants 223 embedded, this is just one exemplary embodiment. The abrasive layer 224 can be comprised of a single material, without abradants 223 embedded, such as polyurethane, polyvinyl alcohol (PVA), polyurethane-impregnated felt, or any other commercially available material that is suitable for this particular type of application. The film backing layer 226 can be comprised of any single polymer or combination of polymers that can provide sufficient rigidity to the abrasive layer 224.

Figure 2C:
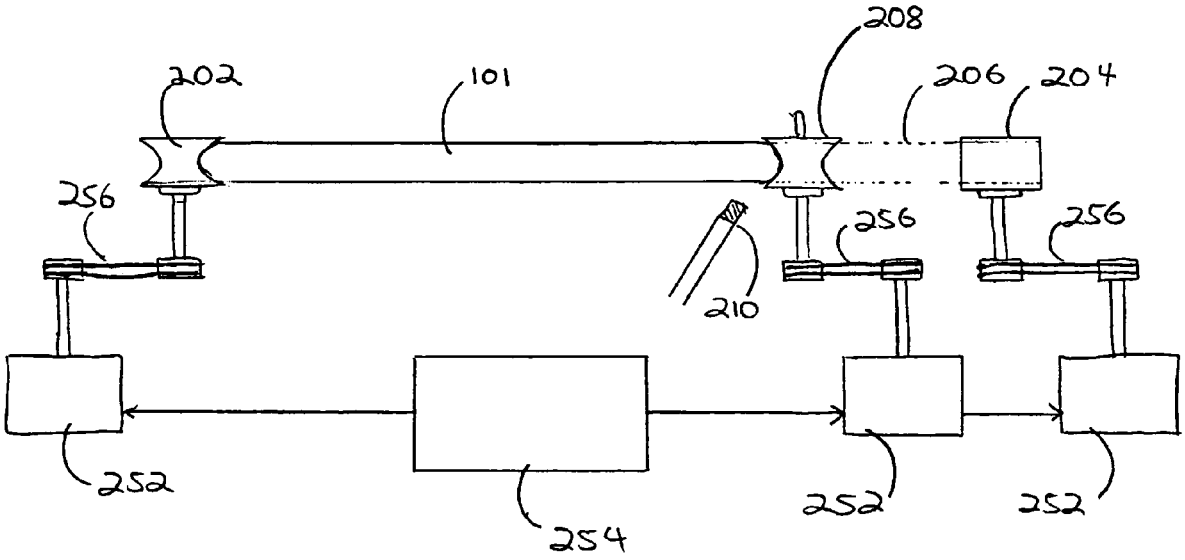
FIG. 2C shows a side view of the wafer cleaning system, in accordance with one embodiment of the present invention.

FIG. 2C shows a side view of the wafer cleaning system, in accordance with one embodiment of the present invention. Shown in this exemplary embodiment are the motorized rotational drives 252 that are attached to drive belts 256 which are in turn attached to the rollers 202, the stator reel 208, and the rewind reel 204. The rollers 202 support the wafer 101 and are powered by the motorized rotational drives 252 to impart a rotational velocity to the wafer 101. The controller 254 communicates with the motorized rotational drives 252 to set the rotational velocity for the rollers 202, stator reel 208 and rewind reel 204. In this embodiment, the motorized rotational drive 252 attached to the rewind reel 204 drives the rewind reel, which pulls the abrasive film 206 across the stator reel 208 at a set feed rate. The feed rate is selected for optimal removal of the contaminant residue on bevel edge of the wafer 101 and to optimize the lifespan of the stator reel 208. One skilled in the art will appreciate that while this depiction shows the stator reel 208 and rewind reel 204 as being attached to the motorized rotational drives 252, any combination of the stator reel 208, rewind reel 204, and supply reel (not shown in this depiction) can be attached to a motorized rotational drive 252. It should also be noted that in some embodiments, the stator reel 208, rewind reel 204, and supply reel will be housed in a cassette format to allow for easy removal and change out during maintenance of the wafer cleaning system. FIG. 2C represents one exemplary drive system, and it will be apparent to one skilled in the art that other drive systems may be employed with the embodiments described herein.

Figure 2D:
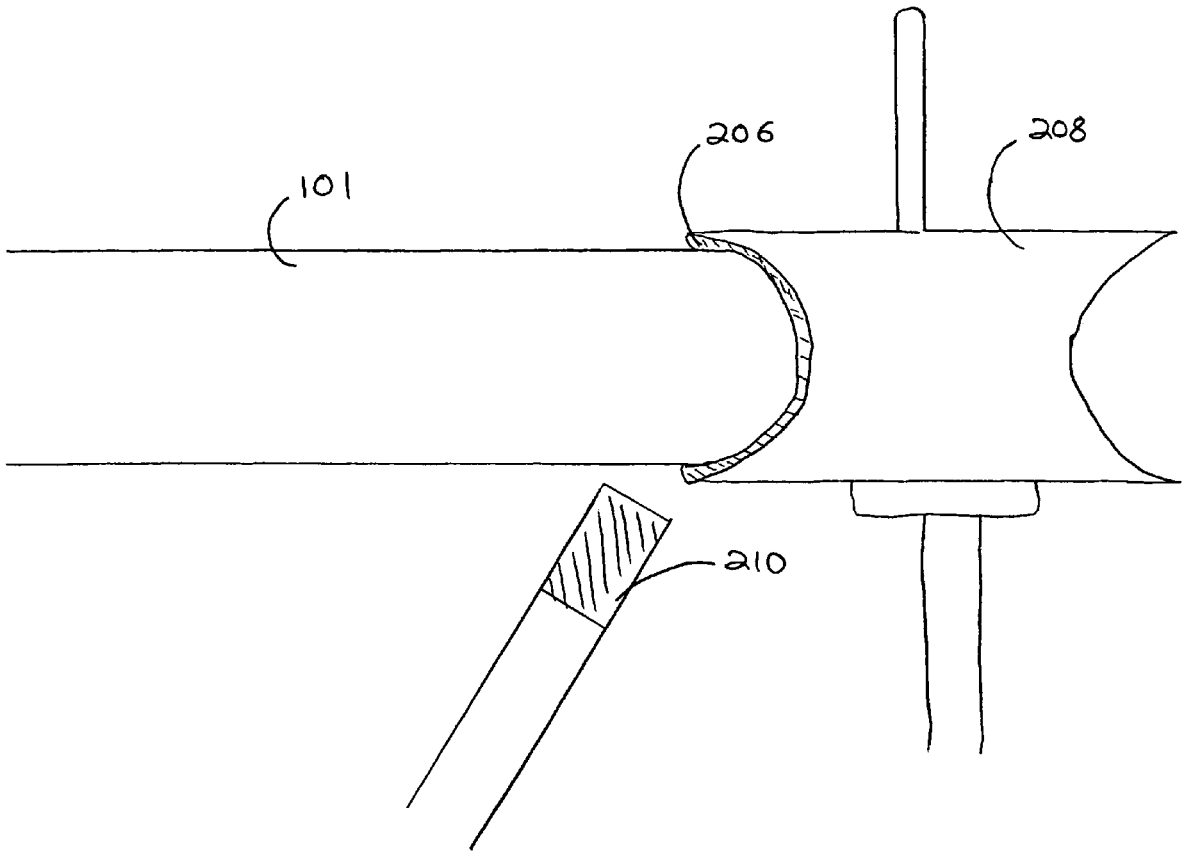
FIG. 2D is an enlarged depiction of the interface between the wafer and the abrasive film, in accordance with one embodiment of the present invention.

FIG. 2D is an enlarged depiction of the interface between the wafer and the abrasive film, in accordance with one embodiment of the present invention. In this exemplary embodiment, the stator reel 208 forces the abrasive film 206 against the bevel edge surface of the wafer 101. The longitudinal surface of the stator reel 208 has a concave shape that conforms to the shape of the bevel edge surface of the wafer 101 allowing the stator reel to accept the wafer 101. When the wafer 101 is rotated against the abrasive film 206, the rubbing of the wafer 101 and the abrasive film 206 dislodges the contaminant residue from the bevel edge surface. As one skilled in the art may appreciate, while this depiction shows the abrasive film 206 having full contact with the surface of the stator reel 208, the abrasive film 206 may be held so that the abrasive film only contacts the stator reel 208 at the top and bottom edges of the stator reel.

Still referring to FIG. 2D, the nozzle is positioned to face the bottom edge surface of the wafer 101 near the interface between the abrasive film 206 and the wafer 101. In this exemplary embodiment, the nozzle 210 sprays a chemical solution against the bottom edge surface of the wafer 101 proximate to an interface defined by the bevel edge of the wafer 101 and the abrasive film 206. As one skilled in the art would appreciate, the nozzle 210 set-up in this depiction is but one exemplary embodiment. One or more nozzles 210 can be used and the positioning of the nozzle(s) 210 can be changed depending on the cleaning requirements of the user. For example, in yet another embodiment, a nozzle 210 can be placed facing the bottom bevel edge surface of the wafer 101 and proximate to where the bevel edge surface emerges from contact with the abrasive film 206. Here, the nozzle can be used to spray a chemical solution such as ultrapure deionized water (DIW) to rinse away contaminant residue dislodged by the rubbing of the abrasive film 206 against the wafer bevel edge.

Figure 2E:
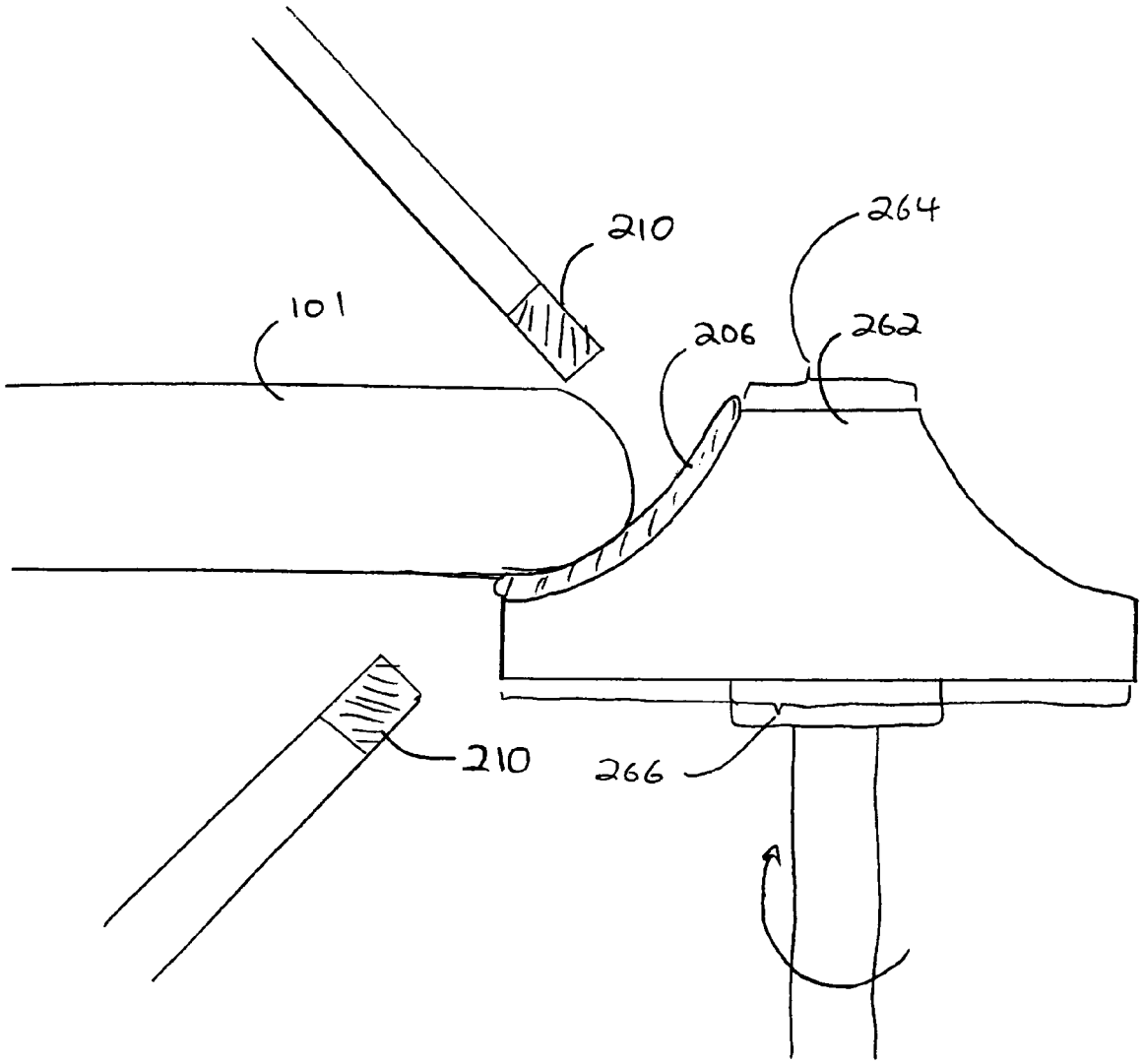
FIG. 2E shows an enlarged depiction of the contact interface between the wafer and abrasive film in accordance with one embodiment of the present invention.

FIG. 2E shows an enlarged depiction of the contact interface between the wafer and abrasive film in accordance with one embodiment of the present invention. In this particular embodiment, a stator reel 262 has a top surface 264 that has a smaller diameter than the bottom surface 266. Nozzles 210 face both the top and bottom surface of the wafer 101 proximate to the interface between the wafer 101 and the abrasive film 206. The longitudinal surface of the stator reel 262 is sloped and curved starting from the top surface 264 continuing down towards the bottom surface 266. During the operation of this particular embodiment, the stator reel 262 forces the abrasive film 206 against the bottom edge of the wafer 101 resulting in the abrasive film 206 being pressed against the sloped surface of the stator reel 262. When the wafer 101 is rotated against the abrasive film 206, the rubbing of the wafer 101 and the abrasive film 206 dislodges the contaminant residue from the bevel edge surface.

Still referring to FIG. 2E, the nozzle 210 facing the top surface of the wafer sprays a chemical solution against the interface between the abrasive film 206 and the wafer 101 to facilitate the removal of the contaminant residue from the wafer 101. The bottom nozzle 210 sprays a chemical solution against the bottom bevel edge surface of the wafer 101 after the area of contact between rubbing against the abrasive film 206 and the bevel edge of the wafer. This is to remove any dislodged contaminant residue particles remaining on the wafer 101 surface from the cleaning operation.

Figure 2F:
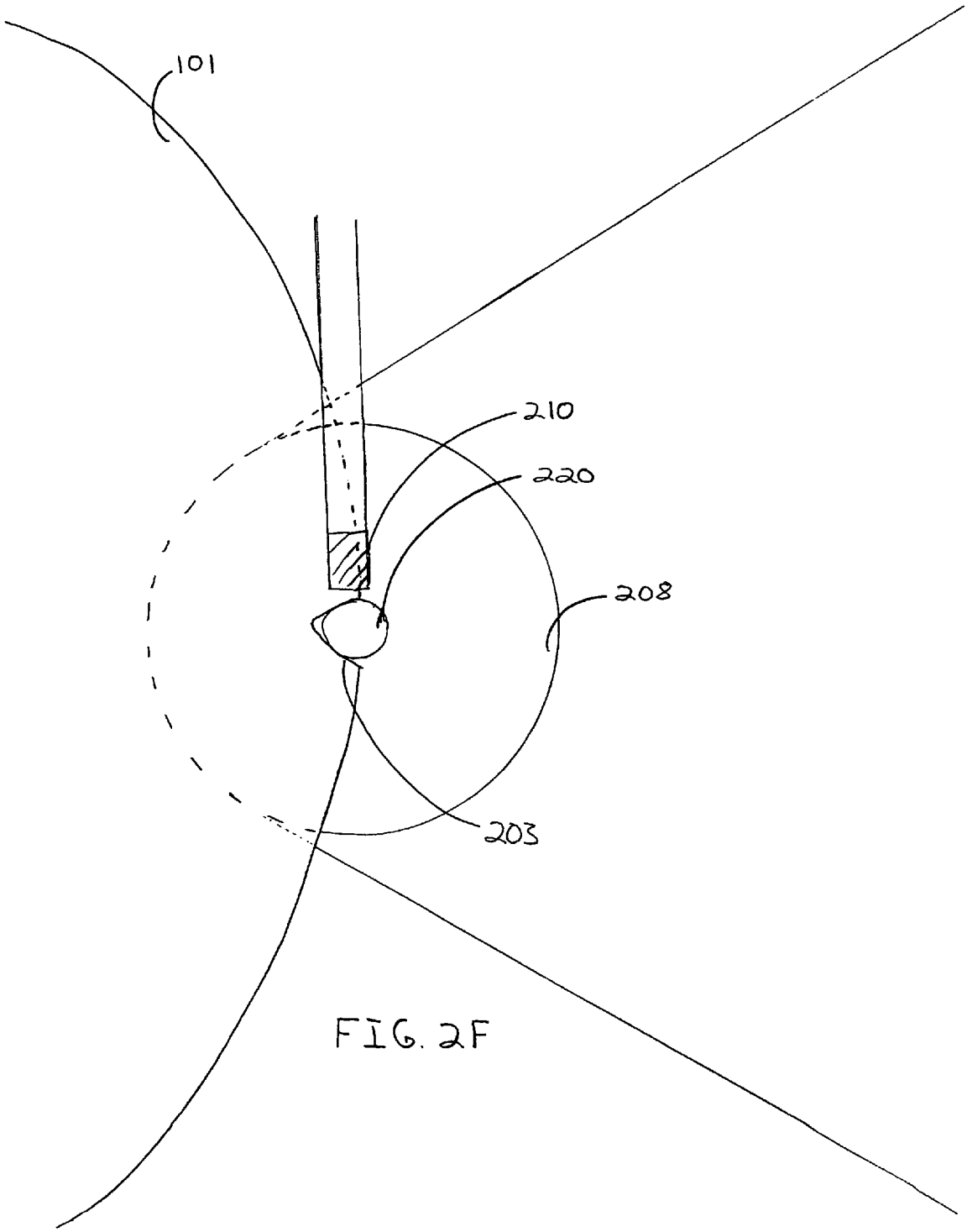
FIG. 2F depicts a top view of the pin cleaning the wafer notch in accordance with one exemplary embodiment of the present invention.

FIG. 2F depicts a top view of the pin cleaning the wafer notch in accordance with one exemplary embodiment of the present invention. In this particular embodiment, there is a pin 220 with an abrasive surface layer protruding from the top surface of the stator reel 208. Nozzle 210 is positioned near the interface of the pin 220 and wafer notch 203. As one who is skilled in the art would appreciate, the abrasive layer of pin 220 may be comprised of a single material or a combination of different materials as discussed above with reference to FIG. 2B. As mentioned above, the resultant abrasive layer has a hardness factor that is less than the hardness factor of the wafer but greater than the hardness factor of the contaminant residue.

Still referring to FIG. 2F, during the wafer notch 203 cleaning operation, the stator reel 208 is lowered below the rotational plane of the wafer 101 and the pin 220 is forced against the wafer notch 203 by the stator reel 208. As the pin 220 is rotated, the abrasive layer rubs against the wafer notch 203 surface which dislodges the contaminant residue that is on the surface of the wafer notch 203. The nozzle 210 sprays a chemical solution on the wafer notch 203 during the notch cleaning operation to facilitate the removal of the contaminant residue. In another exemplary embodiment, the nozzle 210 can spray a chemical solution after the pin 220 is positioned away from the wafer notch 220, to remove any loose contaminant residue particles.

Figure 2G:
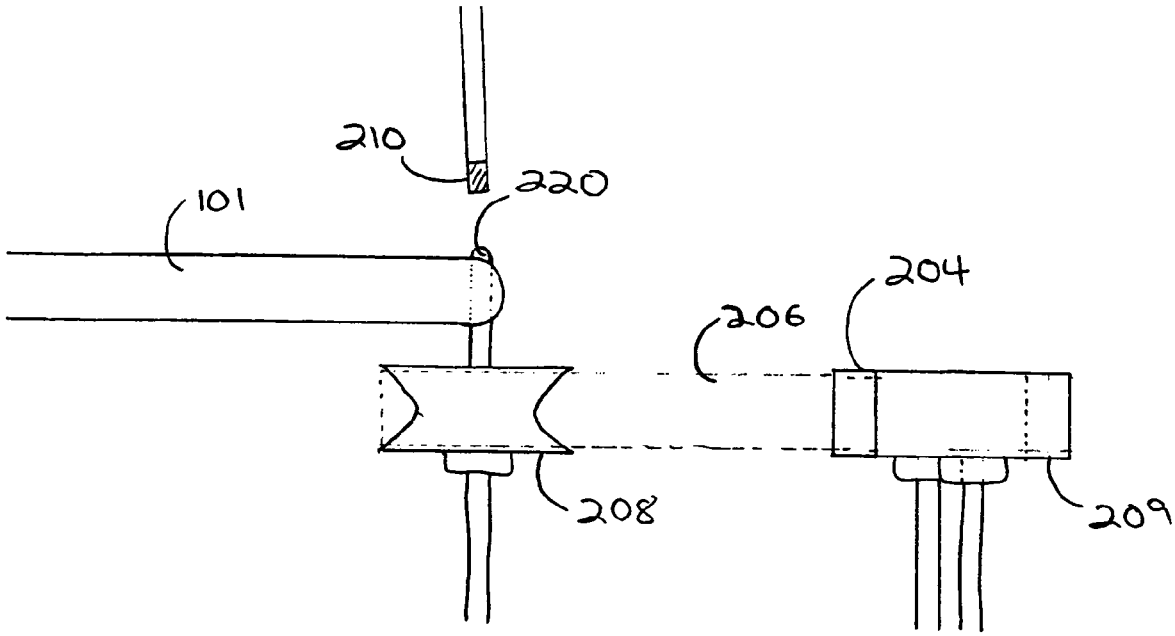
FIG. 2G shows a side view of the pin cleaning the wafer notch in accordance with one embodiment of the present invention.

FIG. 2G shows a side view of the pin cleaning the wafer notch in accordance with one embodiment of the present invention. In this embodiment, the stator reel 208, rewind reel 204, and supply reel 209 are lowered relative to the position of the wafer 101 to allow the pin 220 to contact the wafer notch. This can be accomplished using a variety of means including spring-loaded action, mechanical drives or any other suitable mechanism for moving the pin 220 into the proper position for cleaning the wafer notch 203. A person having ordinary skill in the art will appreciate that while the reels are depicted as having been lowered in relation to the wafer 101, this is not the only way the pin 220 can be positioned to contact the wafer notch. That is, the wafer 101 may also be raised in relation to the stator reel 208 then pushed against the pin 220 so that the notch is cleaned by the pin 220 as the wafer and pin rotate.

Figure 2H:
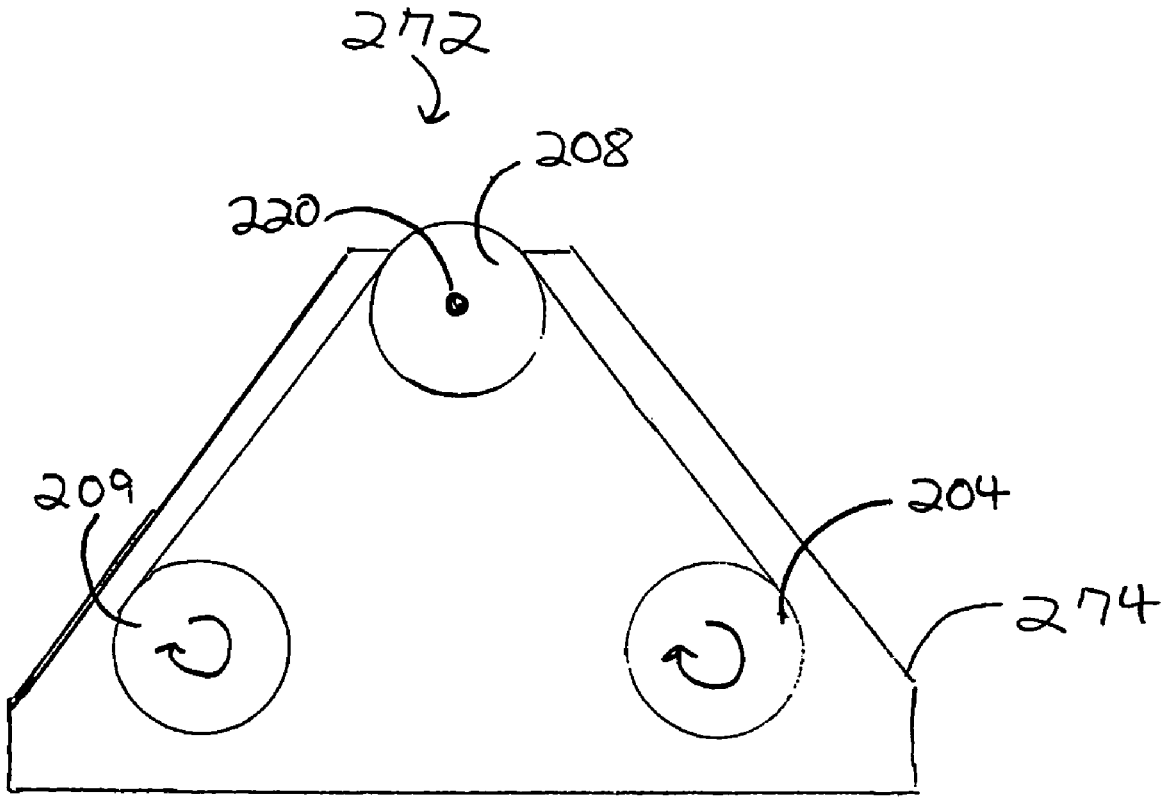
FIG. 2H illustrates a top view of an abrasive film cartridge, in accordance with one exemplary embodiment of the present invention.

FIG. 2H illustrates a top view of an abrasive film cartridge, in accordance with one exemplary embodiment of the present invention. In this embodiment, the stator reel 208 is positioned in the open corner, the supply reel 209 is positioned in the left corner, and the rewind reel 204 is positioned in the right corner of the cartridge 272. The cartridge 272 opening enables the abrasive film on the stator reel 208 to come into contact with the bevel edge of a wafer 101 during wafer cleaning. The cartridge 272 is designed to be easily removed and installed to the motorized drives of the wafer cleaning system. The reels are rigidly supported by the cartridge frame 274 using methods that are well known in the art and will not be described in detail herein.

Figure 3A:
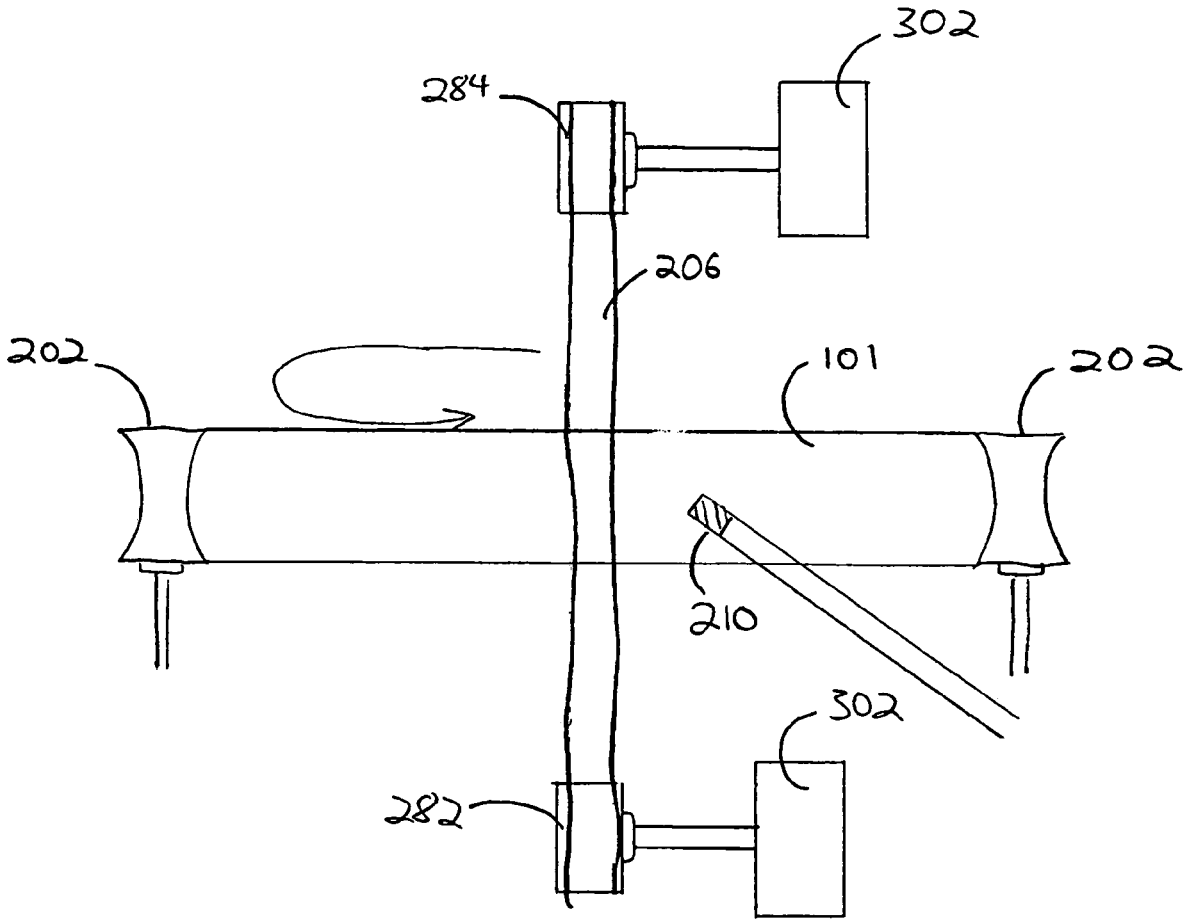
FIG. 3A depicts a schematic of a wafer cleaning system, in accordance with one embodiment of this invention.

FIG. 3A depicts a schematic of a wafer cleaning system, in accordance with one embodiment of this invention. In this particular embodiment, a supply reel 284 is positioned above the wafer 101 and a rewind reel 282 is positioned below the wafer 101. Powered rollers 202 impart rotational velocity to the wafer 101. An abrasive film 206 is held in between the reels and forced against the wafer bevel edge in a substantially orthogonal orientation to the rotational plane of the wafer 101. A nozzle 210 is positioned proximate to the interface between the wafer bevel edge and the abrasive film 206. The supply reel 284 and the rewind reel 282 are attached to motorized drive units 302 that control the feed rate of the abrasive film 206 at an optimal level for removing contaminant residue off the bevel edge surface. For example, the feed rate of the abrasive film 206 may be set at a rate wherein the bevel edge is continually exposed to abrasive film having a minimum level of available abradant. Of course, the feed rate of the abrasive film 206 will be dependent on the rotational velocity of the wafer 101. Of course, only one of the motorized units 302 needs to be engaged during cleaning. The plane of rotation of the supply reel 284 and the rewind reel 282 is orthogonal to that of the plane of rotation of the wafer 101. One skilled in the art will appreciate that while the abrasive film 206 is depicted here as being forced against the wafer bevel edge surface, this is but one exemplary embodiment. That is, the wafer can just as easily be maneuvered so that its bevel edge surface is forced against the abrasive film 206 held in between the supply reel 284 and rewind reel 282.

Still referring to FIG. 3A, the nozzle 210 is positioned so that it sprays a chemical solution onto the interface between the wafer bevel edge surface and the abrasive film 206 to facilitate the removal of the contaminant residue. One additional benefit derived from spraying chemical solution against the wafer 101 is that it rinses off contaminant residue dislodged by the friction of the abrasive film 206 against the wafer bevel edge.

Figure 3B:
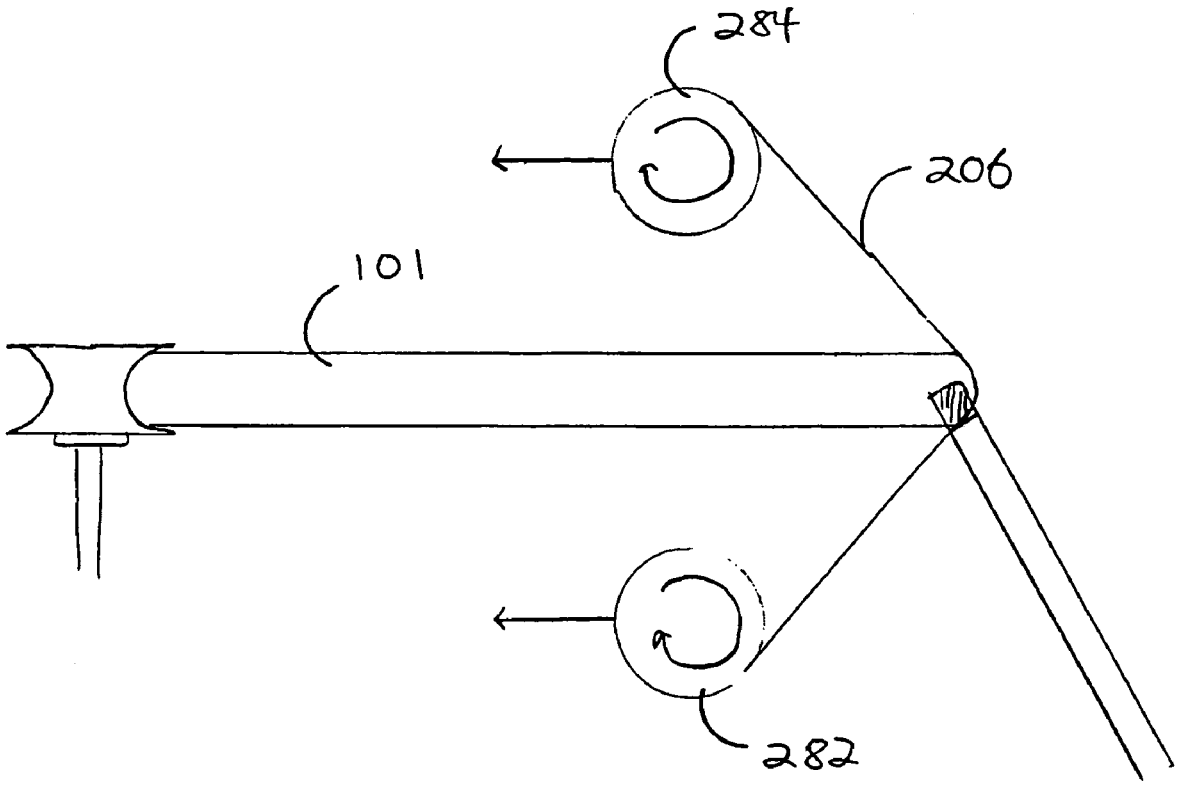
FIG. 3B depicts a side view of the contact interface between the wafer and abrasive film, in accordance with the embodiment shown in FIG. 3A.

FIG. 3B depicts a side view of the contact interface between the wafer and abrasive film, in accordance with the embodiment shown in FIG. 3A. As shown in this particular embodiment, an abrasive film 206 is held in between a supply reel 284 and a rewind reel 282. When the reels are drawn towards the center of the wafer 101, the abrasive film 206 conforms around the bevel edge surface of the wafer 101 and may contact more of the edge exclusion zone. As the wafer 101 rotates, the abrasive film 206 rubs against the bevel edge surface of the wafer 101 dislodging the contaminant residue attached to the wafer bevel edge. During the wafer cleaning operation using this particular embodiment, the abrasive film 206 pre-wound onto the supply reel 284 advances as it is wound onto the rewind reel 282. The feed rate of the abrasive film 206 is optimized for removing contaminant residue from the wafer bevel edge surface and preventing wear and tear on the reels. Both reels, 282 and 284, are designed to be easily replaced during routine equipment maintenance.

Figure 4:
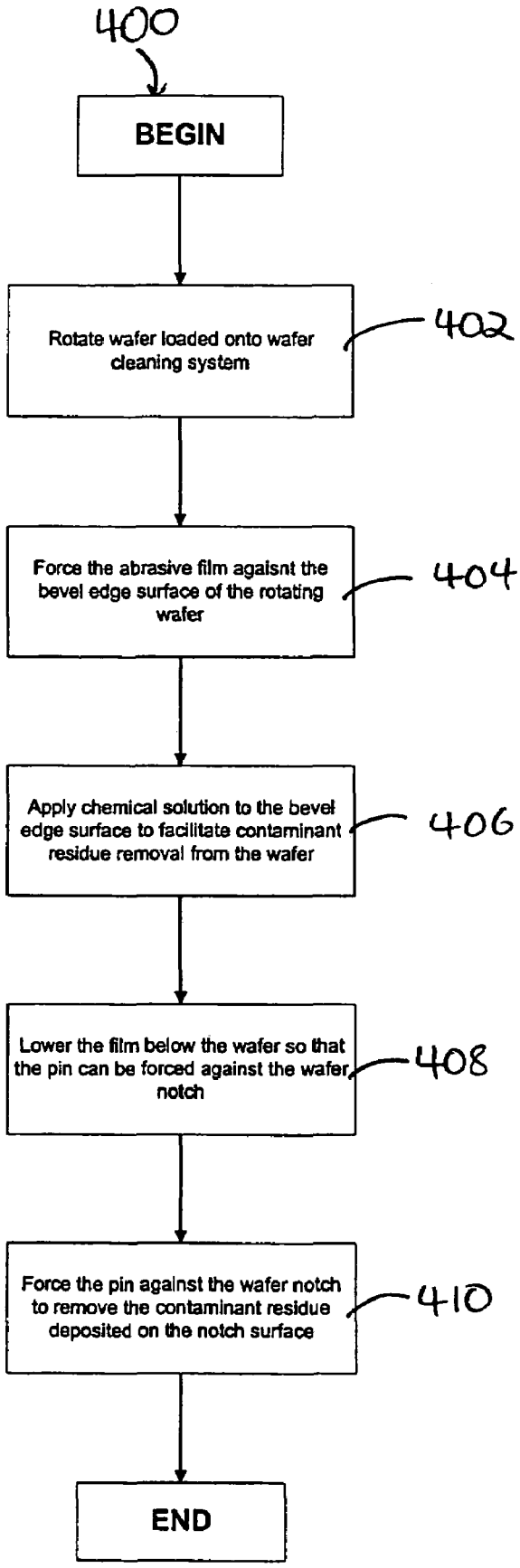
FIG. 4 shows a flow chart for a wafer cleaning method, according to one embodiment of the present invention.

FIG. 4 shows a flow chart for a wafer cleaning method, according to one embodiment of the present invention. An exemplary schematic diagram of the wafer cleaning system utilized in this method is shown in FIGS. 2A and 2C. The method 400 starts with operation 402, where the wafer is loaded onto the wafer cleaning system and rotated at a set rotational velocity. The rotational velocity may be imparted using powered rollers in one embodiment. The method 400 then proceeds to operation 404, where an abrasive film is forced against the bevel edge surface of the wafer 101. For example, a stator reel may be used to force the abrasive film against the bevel edge. Next, the method 400 moves to operation 406, where a nozzle applies a chemical solution to the interface between the bevel edge surface of the wafer and the abrasive film to facilitate the removal of the contaminant residue. After operation 406, the method 400 proceeds to operation 408, where the abrasive film is lowered to a position below the wafer to allow the pin to contact the wafer notch. As mentioned with reference to FIG. 2C, a stator reel which guides the abrasive film may be lowered and moved toward a center of the wafer to enable the pin to contact the bevel edge and notch. Finally, during operation 410 the pin is forced against the wafer notch to dislodge the contaminant residue deposited on the notch. Of course, the pin may be rotated. This method 400 is performed, as detailed in the sequence of operations above, on every wafer 101 that is cleaned using this particular embodiment of the present invention.

Although a few embodiments of the present invention have been described in detail herein, it should be understood, by those of ordinary skill, that the present invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims.

What is claimed is:

1. An apparatus for cleaning an edge surface of a semiconductor substrate, comprising:

a film with an abrasive layer configured to contact the edge surface of a semiconductor substrate coated with a contaminant residue layer;

a first reel having the film wound thereon, a second reel for receiving the film fed from the first reel a third reel configured to force the abrasive layer of the film against the edge surface of the semiconductor substrate to create an area of contact between the abrasive layer and the edge surface of the semiconductor substrate; and a pin that protrudes from a top surface of the third reel for cleaning a notch in the edge surface of the semiconductor substrate.

2. The apparatus according to claim 1, wherein the film held between the first and the second reel is configured to contact the edge surface of the semiconductor substrate in a substantially orthogonal orientation to a planar rotation of the semiconductor substrate.

3. The apparatus according to claim 1, wherein the third reel has a top surface and a bottom surface, the top surface and the bottom surface having a same diameter and a longitudinal surface of the third reel having a concave shape.

4. The apparatus according to claim 1, wherein the third reel is configured to be lowered to a position that allows the pin to contact the edge surface of the semiconductor substrate.

5. The apparatus according to claim 1, wherein the abrasive layer of the film is composed of material having a hardness factor that is less than the semiconductor substrate but greater than that of the contaminant residue layer on the edge surface of the semiconductor substrate.

6. The apparatus according to claim 1, wherein the pin is composed of abrasive material having a hardness factor that is less than the semiconductor substrate but greater than that of the contaminant residue layer on the edge surface of the semiconductor substrate.

7. The apparatus according to claim 1, wherein each of the reels has a cylindrical shape.

8. The apparatus according to claim 1, which further comprises a frame rigidly supporting the first reel, the second reel, and the third reel.

9. The apparatus according to claim 1, wherein at least one of the first reel, the second reel and the third reel is configured to be powered by a motorized rotational drive apparatus.

10. A system for cleaning an edge surface of a semiconductor substrate, comprising:

a cassette having a plurality of reels contained therein, the plurality of reels configured to hold and orient an abrasive film so that the abrasive film contacts the edge surface of the semiconductor substrate;

a nozzle configured to apply a solution to the edge surface of the semiconductor substrate;

a reservoir unit in flow communication with the nozzle, the reservoir unit storing the solution;

a pin that protrudes from a top surface of a one of the plurality of reels for cleaning a notch in the edge surface of the semiconductor substrate; and a plurality of rollers configured to rotatably support the semiconductor substrate against the abrasive film as the abrasive film is wound around one of the plurality of reels.

11. The system for cleaning the edge surface of the semiconductor substrate as recited in claim 10, wherein the solution is selected from the group consisting of $NH_4OH$ (Ammonium Hydroxide), $H_2O_2$ (Hydrogen Peroxide), TMAH (Tetramethylammonium Hydroxide), and HF (Hydrogen Fluoride).

12. The system for cleaning an edge surface of a semiconductor substrate as recited in claim 10, further comprising:

a pump configured to deliver a flow of the solution from the reservoir to the nozzle.

13. The system for cleaning an edge surface of a semiconductor substrate as recited in claim 10, wherein the plurality of rollers is configured to maintain the rotation of the semiconductor substrate at a set velocity.

14. The system for cleaning an edge surface of a semiconductor substrate as recited in claim 10, wherein at least one reel of the plurality of reels of the apparatus is configured to press the abrasive film against the edge surface of the semiconductor substrate.

15. A method of cleaning an edge surface of a semiconductor substrate, comprising method operations of:

rotating the semiconductor substrate;

forcing a compliant abrasive film against the edge surface of the semiconductor substrate as the semiconductor substrate is rotating;

contemporaneously with the forcing, applying a solution to an interface defined between the film and the edge surface of the semiconductor substrate;

removing the compliant abrasive film from the edge surface of the semiconductor substrate;

lowering the compliant abrasive film below the semiconductor substrate; and forcing a pin against the edge surface of the semiconductor substrate.

16. The method of claim 15 wherein the method operation of forcing includes, winding the abrasive film around a reel having the abrasive film connected thereto.

17. The method of claim 15 wherein the method operation of applying a solution includes, delivering the solution to a bottom surface of the edge of the semiconductor substrate at the interface.

18. The method of claim 15 further comprising:

rotating the semiconductor substrate in a first direction; and rotating a reel in a second direction.

19. The method of claim 15 further comprising:

rotating the semiconductor substrate and a reel in a first direction.

* * * * *